US005331900A

United States Patent [19]

Gersemsky

[11] Patent Number: 5,331,900

[45] Date of Patent: Jul. 26, 1994

[54] OVERHEAD TROLLEY WITH SPRING BIASED LOAD DEPENDENT TRACTION CONTROL

[75] Inventor: Udo Gersemsky, Herdecke, Fed. Rep. of Germany

[73] Assignee: Mannesmann Aktiengesellschaft, Dusseldorf, Fed. Rep. of Germany

[21] Appl. No.: 35,354

[22] Filed: Mar. 22, 1993

[30] Foreign Application Priority Data

Mar. 20, 1992 [DE] Fed. Rep. of Germany ..... 4209565

[51] Int. Cl.[5] ..... B61C 11/00; B61C 15/00

[52] U.S. Cl. ..... 105/30; 105/75; 105/153; 105/154

[58] Field of Search ..... 105/30, 73, 75, 150, 105/153, 154; 104/93, 95

[56] References Cited

U.S. PATENT DOCUMENTS

| | | | |
|---|---|---|---|
| 2,282,985 | 5/1942 | Schroeder | 105/154 |
| 2,730,047 | 1/1956 | Rollings | 105/153 |
| 3,518,947 | 7/1970 | Borst | 105/30 |
| 3,774,548 | 11/1973 | Borst | 105/73 X |
| 4,318,346 | 3/1982 | Sessum | 105/73 X |
| 5,069,141 | 12/1991 | Ohara et al. | 105/73 X |

FOREIGN PATENT DOCUMENTS

| | | | |
|---|---|---|---|
| 715395 | 2/1980 | U.S.S.R. | 105/153 |
| 489472 | 7/1938 | United Kingdom | 105/30 |

*Primary Examiner*—Robert J. Oberleitner
*Assistant Examiner*—S. Joseph Morano
*Attorney, Agent, or Firm*—Cohen, Pontani, Lieberman, Pavane

[57] ABSTRACT

A trolley, particularly a monorail trolley having a short structural height includes travel wheels which travel on a lower flange of a rail. The trolley further includes a lifting mechanism arranged on a support frame and a driveable friction wheel which can be pressed through a spring element against the lower flange of the rail. One of the travel wheels and the friction wheel are arranged on a rocker member for a load-dependent increase of the frictional engagement between the rail and the travel wheel and the friction wheel. As seen in travel direction, the friction wheel is spaced from the travel wheel. The rocker member is arranged laterally next to the lower flange and is connected to the support frame so as to be pivotable about an axis. Arranged between the support frame and the rocker member is an adjusting member for changing the distance between the axis and the lower flange. The friction wheel and the travel wheel are connected so as to be triable together.

9 Claims, 4 Drawing Sheets

OVERHEAD TROLLEY WITH SPRING BIASED LOAD DEPENDENT TRACTION CONTROL

BACKGROUND OF THE INVENTION

1. Field of the Invention

The present invention relates to a trolley, particularly a monorail trolley having a short structural height. The trolley has travel wheels which travel on the lower flange of a rail. The trolley further includes a lifting mechanism arranged on a support frame and a drivable friction wheel which can be pressed through a spring element against the lower flange of the rail.

2. Description of the Related Art

U.S. Pat. No. 2,617,365 discloses a trolley of the above-described type which includes a carriage which travels on a rail and on which is arranged a lifting mechanism. The carriage is connected through a drag link to a drivable travel unit which is provided with two wheels traveling on the lower flange of the I-shaped rail. The wheels are each connected through gear wheels for driving the wheels to a friction wheel, wherein the friction wheel rests against the bottom side of the flange, slightly offset relative to the wheels as seen in travel direction. The friction wheels are arranged on a shaft and are driven by a drive motor through a chain. The axes or the shafts of the wheels and the friction wheels are fastened to a support plate. The drive motor is arranged on the support plate in such a way that the pressing force of the wheels and the friction wheels against the lower flange is increased through the support plate, which acts as a lever and the frictional engagement is thus reinforced.

It has been found to be disadvantageous that the connection of the carriage through the drag link with the travel unit significantly increases the structural length of the trolley. In addition, although this type of construction does lead to an increase of the frictional engagement between the wheels and friction wheels and the rail, this increase depends on the weight of the drive motor and is very small. In addition, the increase is not adjustable and does not take into consideration the different load conditions of the trolley.

Also, German patent 1 259 070 discloses a trolley which carries a lifting mechanism, wherein the trolley can travel by means of wheels on the lower flange of an I-shaped rail. The trolley is driven by means of a driven friction wheel which presses from below against the lower flange. The pressing force of the frictional wheel is applied by a pre-tensioned spring and is adjustable.

This type of drive of the trolley is useful for many types of applications because the pressing force of the friction wheel is adjustable. However, also in this case, the pressing force of the friction wheel does not automatically adapt to the load applied to the trolley. Moreover, in order to be able to transmit the necessary drive forces when the wheels are not driven, it is necessary to have a friction wheel which is of rubber or plastics materials having good frictional properties. This results in drive problems when the friction values decrease due to moisture.

German patent 491 527 discloses a trolley which travels on the lower flange of a rail and has a short structural height. This trolley consists essentially of a lifting mechanism, a support frame, a carriage with drive, and a counterweight. The lifting mechanism and the drive are fastened on opposite sides of the support frame which engages an I-shaped travel rail from below and approximately on the same vertical level with the rail. A counterweight is arranged on the side of the support frame located opposite the lifting mechanism, so that the trolley is balanced in such a way that the center of gravity is located below the middle of the rail.

While this trolley does have a low structural height, the eccentric arrangement of the lifting mechanism requires a counterweight for balancing the trolley. In addition to a disadvantageous increase of the weight, this also results in an increase of the structural size of the trolley, particularly when the counterweight is fastened to the support frame through lever arms.

SUMMARY OF THE INVENTION

Therefore, it is the object of the present invention to provide a trolley of the above-described type, particularly a monorail trolley having a short structural height which is of compact construction and has a reliable drive.

In accordance with the present invention, one of the travel wheels and the friction wheel are arranged on a rocker member for the load-dependent increase of the frictional engagement between the rail and the travel wheel and the friction wheel. As seen in travel direction, the friction wheel is spaced from the wheel. The rocker member is arranged laterally next to the lower flange and is connected to the support frame, so as to be pivotable about an axis. Arranged between the support frame and the rocker member is an adjusting means for changing the distance between the axis and the lower flange. The friction wheel and the travel wheel are connected so as to be drivable together.

The arrangement of a rocker member according to the present invention, with a travel wheel and a friction wheel directly on the support frame of the trolley, provides the result that the pressing force of the travel wheel and of the friction wheel against the lower flange of the rail is automatically adjusted in dependence on the load acting on the lifting mechanism, i.e., the load acting on the rocker member through the support frame results, through a lever action, in an increase of the frictional engagement between the wheels and the rail.

In accordance with a feature of the present invention, the point of connection of the rocker member to the support frame is vertically adjustable by means of an eccentric bushing. This feature makes it possible for all wheels to rest on the rail, even though the axis on the rocker member for fastening the rocker member to the support frame changes its vertical position due to an adjustment to different flange thicknesses as a result of the pivoting of the rocker member.

Because the drive is provided for the travel wheel, and the friction wheel is connected to this travel wheel through a drive connection, not only the friction wheel but also the travel wheel transmits drive forces to the rail, so that it is sufficient to drive only this pair of wheels, and complicated drive connections between the wheels, particularly connections to the wheels on the opposite side of the rocker member, become unnecessary.

By providing the friction wheel between the wheels as seen in travel direction, the pressing forces of the friction wheel are distributed to the four travel wheels and, thus, a particularly stable support of all four travel wheels of the trolley is achieved.

In accordance with another feature, the rocker member is constructed as a housing for receiving the gear wheels which mesh with each other and are connected to the friction wheel and the travel wheel, respectively. This provides the advantage of a closed mounting of the gear wheels which requires little maintenance. In addition, exchanging the wheels after they have been worn is made simpler.

A particular advantage is an essentially triangular configuration of the rocker member, wherein axles arranged in the corners of the triangular rocker member support the travel wheel, the friction wheel, and the fastening means of the rocker member to the support frame, and wherein the rocker member is connected to the support frame in front of or behind the axes of the travel wheels and friction wheels and on the side of the travel wheel, so that the lever effect is achieved which increases the frictional engagement. By selecting the distance between the axes for fastening the rocker member and a plane extending perpendicularly through the axis of the travel wheel when making the trolley, the magnitude of the increase of the frictional engagement can be pre-selected by the load acting on the rocker member.

In addition, by providing the rocker member and arranging two travel wheels on that side of the housing of the lifting mechanism which faces the rail, the trolley is of compact construction. This makes it possible to construct the support frame in an L-shape only as seen in travel direction, because the lifting mechanism forms the remaining portion of the trolley engaging around the lower flange in a U-shaped configuration.

Moreover, when the trolley according to the present invention is constructed as a monorail trolley having a short structural height, it is possible in an advantageous manner to omit the arrangement of a counterweight on the side located opposite the lifting mechanism because, on the one hand, a smaller eccentricity of the lifting mechanism results from the direct arrangement of the travel wheels on the housing of the lifting mechanism and because, on the other hand, the remaining forces are introduced from the friction wheel into the lower flange of the rail. The resulting pressure applied by the friction wheel from below is additionally transmitted through the rocker member onto the wheel in approximately the same magnitude. Also, the slightly offset arrangement of the load receiving means from the rail center to the drive results in a lower torsional load acting on the rail.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWING

The present invention is further described in detail below with reference to the accompanying drawing, in which.

DESCRIPTION OF THE PRESENTLY PREFERRED EMBODIMENTS

Figure 1:
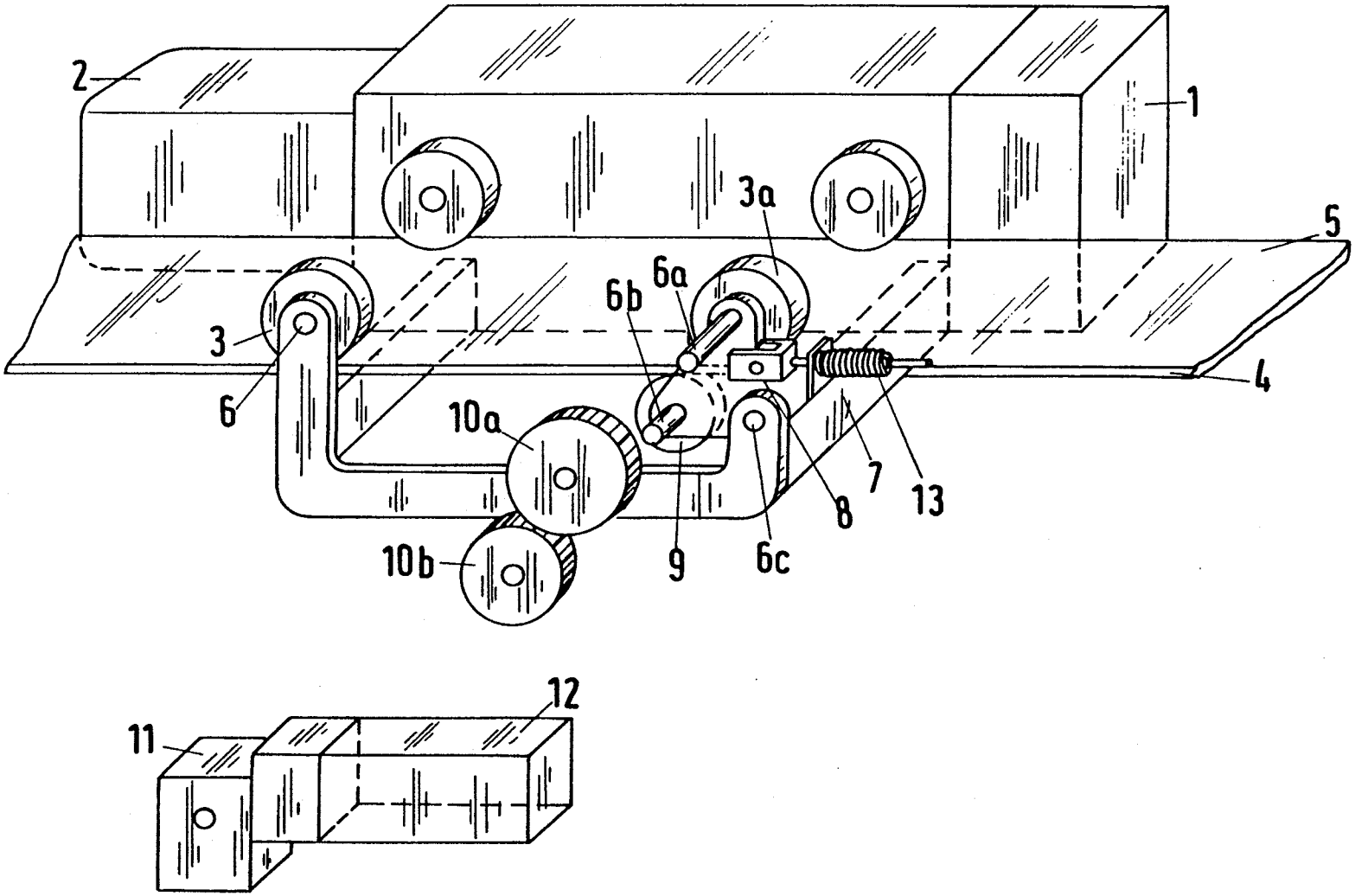
FIG. 1 is an exploded view of a monorail trolley having a short structural height.

FIG. 1 of the drawing shows the trolley according to the present invention in an exploded view. The trolley is composed essentially of a lifting mechanism 1 with a drive 2 having an electric motor, and with a carriage having three non-driven travel wheels 3 and a driven travel wheel 3*a*. The travel wheels 3, 3*a* travel on a lower flange 4 of a partially illustrated I-shaped rail 5. The lifting mechanism 1 is connected to a support frame 7 which is L-shaped as seen in travel direction. At the free ends of the support frame 7 and directly at the housing of the lifting mechanism 1, the travel wheels 3, 3*a* are mounted on axes 6, 6*a* at the front and at the end of the lifting mechanism 1 as seen in travel direction. The axes 6, 6*a* are arranged in such a way that this structural unit surrounds the lower flange 4 in a C-shaped configuration. The driven wheel 3*a* arranged on the support frame 7 is not directly connected to the support frame 7 but through a rocker member 8.

Figure 2:
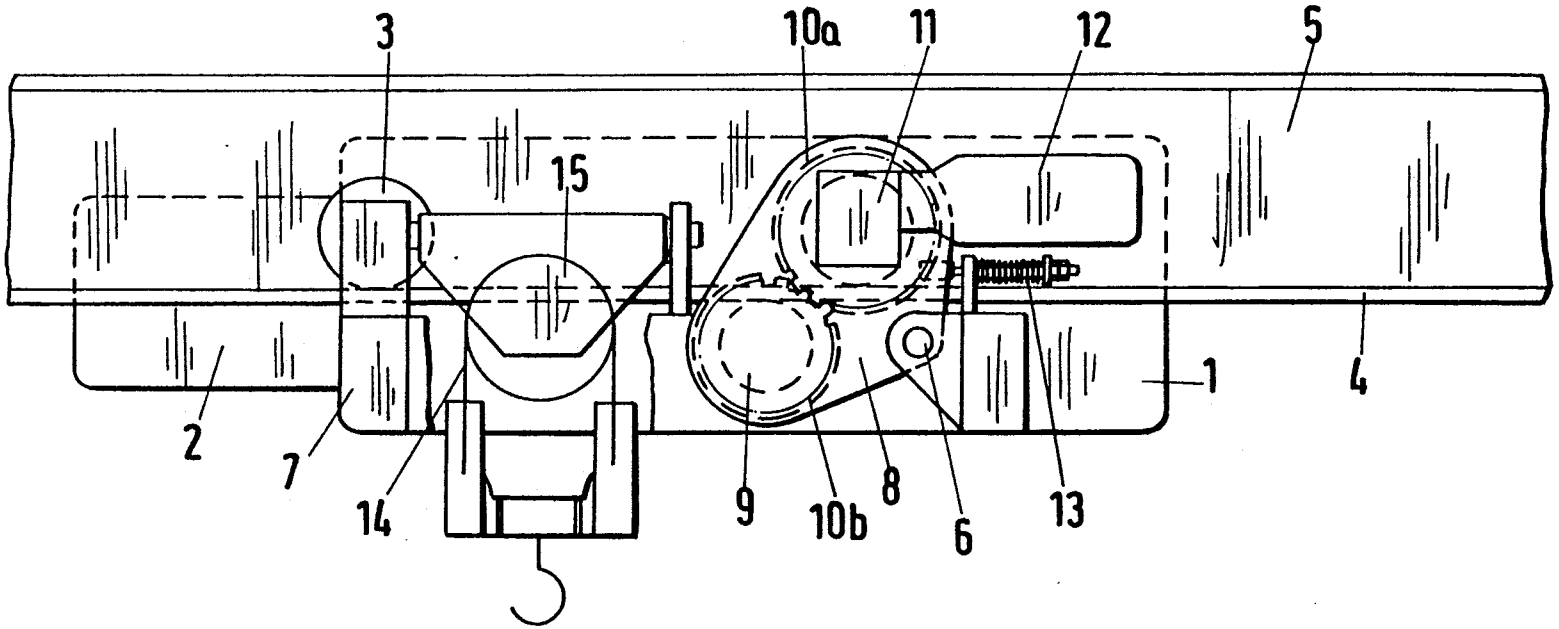
FIG. 2 is a schematic side view of a monorail trolley having a short structural height.

As can be seen in FIG. 2 of the drawing, the rocker member 8 is essentially a triangular member of sheet metal, wherein axes 6*a*, 6*b*, 6*c* are each located at a respective corner of the triangular member. The axis 6*a* is arranged above the lower flange 4 for receiving the travel wheel 3*a* and the two other axes 6*b*, 6*c* are arranged below the lower flange 4. The axis 6*c* serves to fasten the rocker member 8 to the support frame 7, and the axis 6*b*, which is arranged spaced from the axis 6*a* in travel direction, serves to receive a friction wheel 9 which contacts the lower flange 4 from below. The axes 6*a*, 6*b* extend parallel to each other and are in drive connection with each other through gear wheels 10*a*, 10*b* mounted on the axes 6*a*, 6*b*, wherein the axis 6*a* of the travel wheel 3 is driven by a drive 12 through a gear unit 11.

The rocker member 8, which can be swung about the axis 6 mounted on the support frame 7, is adjustable by means of a spring element 13 resting against the support frame 7 in such a way that the travel wheel 3 at the rocker member 8 and the friction wheel 9 are pressed from the top or from below against the lower flange 4 of the rail 5 depending on the swinging movement of the rocker member 8. As a result, in addition to the increase of the frictional engagement due to the load, the pressure applied by the wheels can be additionally increased in order to ensure in this manner that the operation is sufficiently secured against slippage in all types of loading and operating conditions, for example, in the case of moisture.

Figure 3:
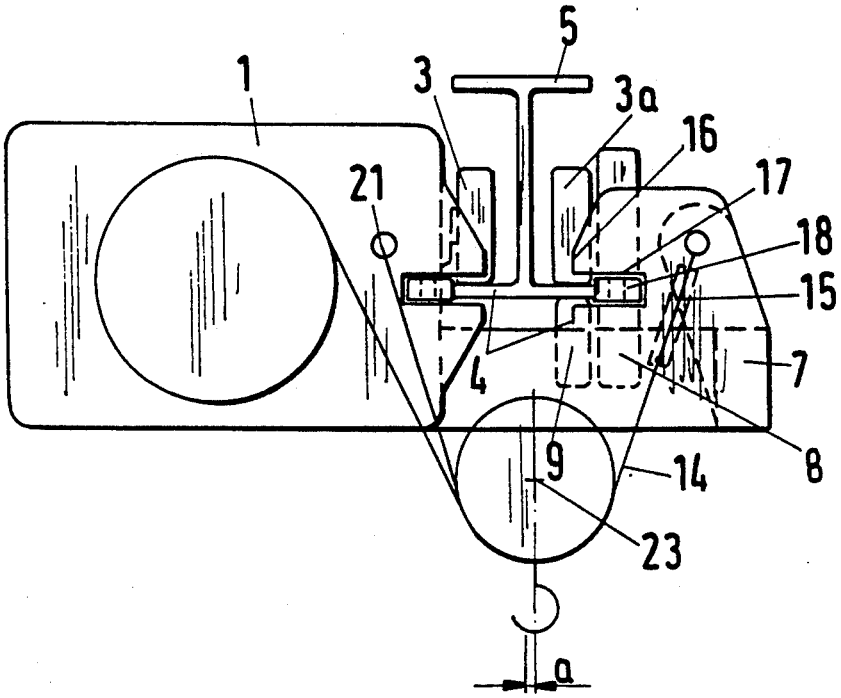
FIG. 3 is a front view of the trolley of FIG. 2.

FIG. 2 is a side view of a monorail trolley having a short structural height. In addition to FIG. 1, FIG. 2 shows that the lifting rope 14 is deflected in accordance with a 4/1 guidance over a pulley 15 mounted on the support frame 7, wherein, as shown in FIG. 3, the fixed point 21 of the lifting rope 14 is at the lifting mechanism 1. In the illustrated embodiment, the lifting mechanism 1 is mounted so as to extend parallel to the rail 5 in its longitudinal direction, and the lifting mechanism 1 is arranged laterally next to, and on approximately the same level of, the rail 5.

FIG. 3 is a front view of the trolley of FIG. 2. FIG. 3 shows that two travel wheels 3 are directly fastened to that side of the housing of the lifting mechanism 1 which faces the I-shaped rail 5. The housing of the lifting mechanism 1 and the support frame 7 are provided with oppositely located triangular projections 16 at the front and the rear, as seen in travel direction. The projections 16 form U-shaped recesses 17. The recesses 17 extend around and are spaced from the lower flange 4 of the rail 5. Mounted in the recesses 17 are guide rollers 18 which are each rotatable about a vertical axis. The guide rollers 18 roll on the side edges of the lower flange 4. The projections 16 serve to prevent falling.

FIG. 3 further shows that the center of the load receiving means 23 is arranged offset by a distance a from the center of the rail 5 toward the rocker member 8. The magnitude of the distance a corresponds to the eccentric effect of the weight of the lifting mechanism 1 itself when a maximum load is applied to the trolley. This results in a minimum torsional load on the rail 5 in the case of a maximum load on the trolley.

The lifting mechanism 1 may be constructed as an electric lifting mechanism.

Figure 4:
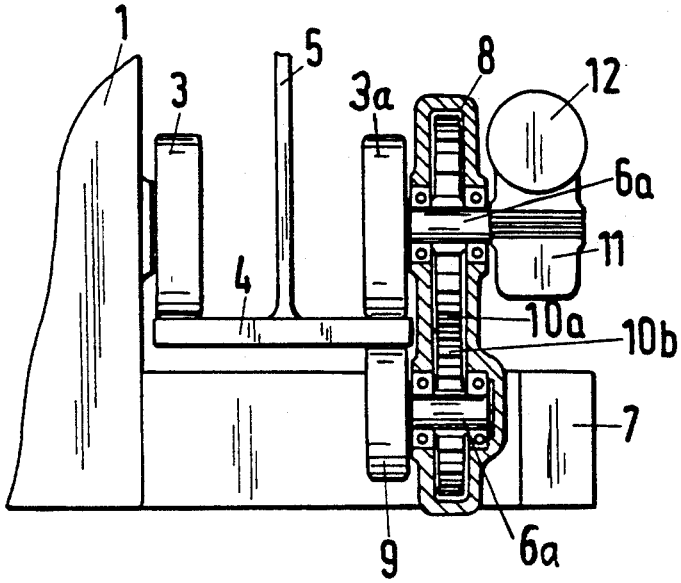
FIG. 4 is a partial sectional view, on a larger scale, of the trolley of FIG. 2 in the region of the rocker member.

FIG. 4 of the drawing shows a specific embodiment of the rocker member 8. In this embodiment, the rocker member 8 is not constructed as a sheet metal member with bores for receiving the axes 6*a*, 6*b*. Rather, the rocker member 8 is constructed as a housing which can be longitudinally divided and which serves for receiving and protecting the gear wheels 10*a*, 10*b* whose transmission ratio corresponds exactly to the ratio of the diameters of the travel wheel 3*a* and the friction wheel 9.

Figure 5:
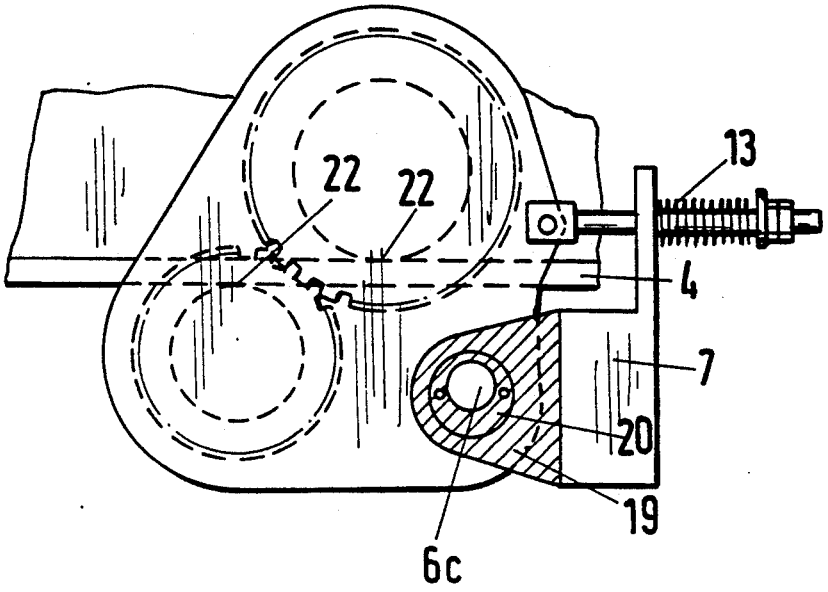
FIG. 5 is a partial view, on a larger scale, showing the rocker member of the trolley of FIG. 2 with an eccentric member adjusted into a position for large flange thicknesses of the rail.
Figure 6:
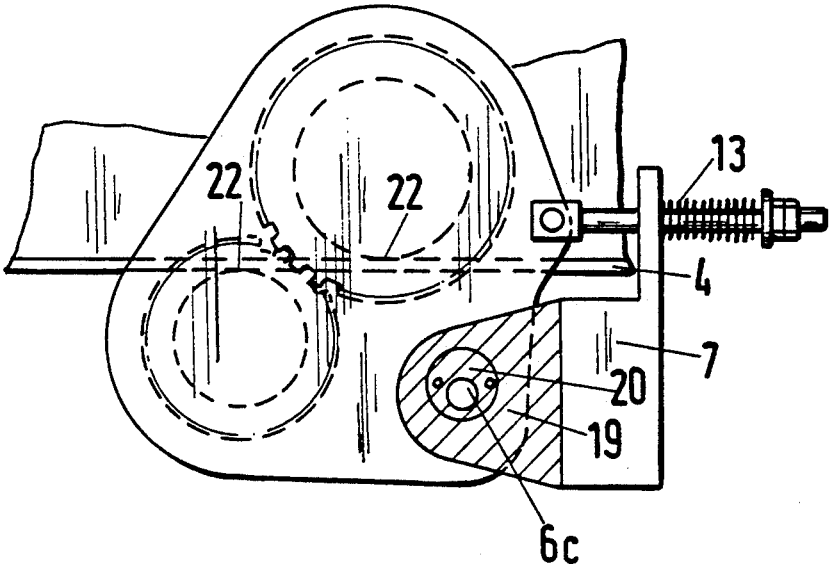
FIG. 6 is a partial view, on a larger scale, showing the rocker member of the trolley of FIG. 2 with an eccentric member adjusted into a position for small flange thicknesses of the rail.

FIGS. 5 and 6 show, on a larger scale, details of the trolley of FIG. 2 in the area of the rocker member 8. The rocker member 8 can be swung about the axis 6*c* which extends transversely of the travel direction and is arranged in a lug 19 on the support frame 7. By swinging the rocker member 8 about the axis 6*c*, it is possible to increase or decrease the distance between the tangents extending through the contact points 22 of the travel wheel 3*a* and the friction wheel 9 with the rail 5. In other words, the rocker member 8 of the friction wheel drive can be adapted to different thicknesses of the lower flange 4. However, this adjustment of the rocker member 8 results in a change in the distance between the axis 6*c* on the support frame 7 and the lower flange 4 of the rail 5, so that a four-point support of all wheels 3 would be prevented. In order to restore the four-point support after the drive friction wheel has been adapted to the thickness of the lower flange 4, the axis 6*c* is constructed so as to be adjustable in the direction toward the lower flange 4 by an adjusting means 20 constructed as an eccentric bushing and mounted in the lug 19. The eccentric bushing can be fixed in this position, for example, by means of a pressure wedge connection, not shown. FIG. 5 shows the axis 6*c* in the position having the minimum distance from the lower flange 4.

FIG. 6 shows the adjustment of the eccentric bushing for a minimum flange thickness, wherein the vertical change of the axis 6*c* resulting from the adjustment is compensated by turning the eccentric bushing downward. This adjustment results in the maximum distance of the axis 6*c* on support frame 7 from the lower flange 4.

In addition, as is clear from FIGS. 5 and 6, an increase of the distance between the axes 6*a*, 6*c* in travel direction, which corresponds to the lever arm for the increase of the frictional engagement of the travel wheel 3*a* and the friction wheel 9, leads to an increase of the load-dependent frictional engagement. Accordingly, this desired increase can be taken into consideration when constructing the rocker member.

Moreover, by decreasing the above-described distance, the load-dependent increase of the frictional engagement for the friction wheel can be reduced to zero. In this case, the axes 6*a*, 6*c* are arranged on the same level as seen in travel direction, i.e., the axes 6*a*, 6*c* are arranged one above the other when the rail extends horizontally and the increase of the frictional engagement relative to the friction wheel takes place exclusively through the spring element, and the increase of the frictional engagement for the wheel mounted on the rocker member is effected through the spring element, on the one hand, and continues to be effected in dependence on the load acting on the support frame, on the other hand.

It should be understood that the preferred embodiments and examples described are for illustrative purposes only and are not to be construed as limiting the scope of the present invention which is properly delineated only in the appended claims.

We claim:

1. A trolley system including a rail, the rail having a lower flange, the trolley system comprising travel wheels traveling on an upper surface of the lower flange of the rail, further comprising a support frame and a lifting mechanism mounted on the support frame, a friction wheel, drive means for driving the friction wheel, and a spring element for pressing the friction wheel from below against the lower flange, the travel wheels including a first travel wheel, a rocker member connected to the first travel wheel and the friction wheel for a load-dependent increase of the frictional engagement between the lower flange and the first travel wheel and the friction wheel, the friction wheel being mounted at a distance in a travel direction from the first travel wheel, the rocker member being mounted on a side next to the lower flange, a first axis for pivotally connecting the rocker member to the support frame, the first travel wheel being mounted on a second axis, a distance being defined between the second axis and the lower flange, an adjusting means mounted between the support frame and the rocker member for changing the distance between the second axis and the lower flange, wherein the drive means for the friction wheel is connected to drive means for the first travel wheel.

2. The trolley system according to claim 1, wherein the travel wheels of the trolley system include front travel wheels mounted in travel direction in front of the first travel wheel and wherein the friction wheel is arranged in travel direction between the first travel wheel and the front travel wheels.

3. The trolley system according to claim 1, comprising a drive mounted on the rocker member for driving the drive means of the first travel wheel.

4. The trolley system according to claim 1, wherein the drive means of the friction wheel and the drive means of the first travel wheel comprise gear wheels which mesh with each other.

5. The trolley system according to claim 4, wherein the rocker member comprises a housing for receiving the gear wheels.

6. The trolley system according to claim 1, wherein the adjusting means is an eccentric bushing.

7. The trolley system according to claim 1, wherein the rocker member is essentially triangular defining corners, the first and second axis being mounted in two of the corners and a third axis for receiving the first travel wheel being mounted in a third of the corners, wherein the first axis for fastening the rocker member is arranged on a side of the first travel wheel outside of a region defined by centers of the second and third axes.

8. The trolley system according to claim 7, wherein the first axis for fastening the rocker member is mounted underneath the lower flange.

9. The trolley system according to claim 1, comprising a housing for the lifting mechanism mounted on a side of the rail opposite the first travel wheel, front and rear travel wheels being mounted on the housing of the lifting mechanism.

* * * * *